US008695760B2

(12) United States Patent
Winter, IV

(10) Patent No.: US 8,695,760 B2
(45) Date of Patent: Apr. 15, 2014

(54) TELESCOPING PULL-DOWN ATTIC LADDER

(75) Inventor: Amos G Winter, IV, Concord, NH (US)

(73) Assignee: Appropriate Combined Technologies, LLC, Santa Clara, CA (US)

( * ) Notice: Subject to any disclaimer, the term of this patent is extended or adjusted under 35 U.S.C. 154(b) by 62 days.

(21) Appl. No.: 13/359,737

(22) Filed: Jan. 27, 2012

(65) Prior Publication Data

US 2012/0193167 A1 Aug. 2, 2012

Related U.S. Application Data

(60) Provisional application No. 61/437,093, filed on Jan. 28, 2011.

(51) Int. Cl.
*E04G 27/00* (2006.01)

(52) U.S. Cl.
USPC ..... 182/97; 182/77; 182/127; 182/195

(58) Field of Classification Search
USPC ..... 182/77–81, 195, 89, 93, 94, 95, 97, 99, 182/156, 157, 158, 127
See application file for complete search history.

(56) References Cited

U.S. PATENT DOCUMENTS

| | | | | | |
|---|---|---|---|---|---|
| 427,771 | A * | 5/1890 | Knowles | 182/95 |
| 877,363 | A * | 1/1908 | Nielsen | 182/81 |
| 2,207,445 | A * | 7/1940 | Seidner | 182/116 |
| 2,528,074 | A * | 10/1950 | Patton | 105/457 |
| 2,567,302 | A * | 9/1951 | Sip | 182/104 |
| 2,827,216 | A * | 3/1958 | Napolitano | 182/104 |
| 3,180,451 | A * | 4/1965 | Patterson | 182/106 |
| 3,263,773 | A * | 8/1966 | Sallein | 182/158 |
| 3,386,531 | A * | 6/1968 | Sallein | 182/207 |
| 4,541,508 | A * | 9/1985 | Lundh | 182/78 |
| 4,989,692 | A * | 2/1991 | Min | 182/166 |

(Continued)

FOREIGN PATENT DOCUMENTS

| | | |
|---|---|---|
| GB | 380172 | 6/1931 |
| GB | 903608 | 6/1961 |

OTHER PUBLICATIONS

Definition of 'Cooperative' Provided in the Action Collins English Dictionary—Complete and Unabridged © HarperCollins Publishers 1991, 1994, 1998, 2000, 2003.*

(Continued)

*Primary Examiner* — Katherine Mitchell
*Assistant Examiner* — Daniel Cahn
(74) *Attorney, Agent, or Firm* — Maine Cernota & Rardin

(57) ABSTRACT

An attic ladder system includes an upper portion that can be extended above the attic floor and a lower portion that can be extended into a room below the attic. The upper portion can extend automatically into the attic upon extension of the lower portion, or may be operated independently of the lower section. Ladder extension can be telescopic or by unfolding of sections. Retraction of either or both ladder portions may include a pivoting capability to reduce vertical height when stored. A gap can be provided between lowest the rungs to avoid danger to a user's hands. Embodiments can be used to access the top of a vehicle roof from within the vehicle. Embodiments can support a user weighing up to 300 pounds. A gas spring can assist in lifting and stowing the lower portion. Pivot latches can secure the ladder in its stowed and deployed configurations.

10 Claims, 8 Drawing Sheets

(56) References Cited

U.S. PATENT DOCUMENTS

| | | | | |
|---|---|---|---|---|
| 5,279,389 | A * | 1/1994 | Crockett | 182/129 |
| 5,495,915 | A * | 3/1996 | Weston et al. | 182/195 |
| 6,378,654 | B1 * | 4/2002 | Ziaylek et al. | 182/97 |
| 7,448,637 | B2 * | 11/2008 | Parker | 280/166 |
| 7,748,498 | B2 * | 7/2010 | Parker | 182/195 |
| 7,806,233 | B2 * | 10/2010 | Parker | 182/207 |
| 7,967,110 | B2 * | 6/2011 | Parker | 182/77 |
| 8,028,805 | B2 * | 10/2011 | Parker | 182/195 |
| 8,151,936 | B2 * | 4/2012 | Parker | 182/77 |
| 8,348,015 | B2 * | 1/2013 | Parker | 182/77 |
| 2006/0124398 | A1 * | 6/2006 | Parker | 182/207 |
| 2007/0084670 | A1 * | 4/2007 | Parker | 182/195 |
| 2007/0209875 | A1 * | 9/2007 | Chen | 182/195 |
| 2007/0234654 | A1 * | 10/2007 | Eriksson et al. | 52/184 |
| 2009/0166129 | A1 | 7/2009 | Siler et al. | |
| 2011/0240405 | A1 * | 10/2011 | Parker | 182/195 |

OTHER PUBLICATIONS

Werner, AA8 22 W×22 L min x 8' Ceiling Televator Telescoping Aluminum Attic Ladder, http://us.wernerco.com/view/Products/Climbing-Equipment/Attic-Ladders/AA/AA8, 2 pgs.

Lynn Ladder & Scoffolding Co., Inc., Elite Aluminum Attic Ladder, http://www.lynnladder.com/products/Elite-Aluminum-Attic-Ladder.html, 2 pgs.

Telesteps, Technical Data, http://www.telesteps.net/technical.htm, 1 pg.

* cited by examiner

TELESCOPING PULL-DOWN ATTIC LADDER

RELATED APPLICATIONS

This application claims the benefit of U.S. Provisional Applications No. 61/437,093, filed Jan. 28, 2011, which is incorporated herein by reference in its entirety for all purposes.

FIELD OF THE INVENTION

The invention relates to a pull-down attic ladder, and more particularly, to a pull-down attic ladder which telescopes and extends above the opening in the attic or next level floor to provide easy and safe access.

BACKGROUND OF THE INVENTION

Traditional attic or scuttle-mounted ladders when unfolded for use provide step platforms only up to the opening in the attic floor. This makes it difficult and unsafe to get off the ladder and climb into the attic, in some cases on one's knees while trying to avoid stepping between the joists and crashing through the ceiling, or in any event, retaining balance while ascending to standing height on the attic or second level floor. Additionally, coming back down, whether facing towards or away from the ladder steps, presents safety challenges to regaining footing on the ladder below the attic opening. One wrong step could result in a fall and serious injury.

One approach is to install a permanent railing or a permanent ladder extension above the opening in the attic or second level floor, but this approach may consume valuable space, hinder movement through an already crowded attic, or simply be impractical for other reasons.

Another approach is to attach the ladder at a hinge point below its top, so that an upper portion of the ladder swings into the attic above the opening when the lower portion is pivoted and extended below the floor of the attic. However, this approach extends the length of the ladder in its stowed configuration and makes it more difficult to store conveniently. Also, the portion that extends into the attic or second floor space may interfere with movement on the second floor or access to and from the ladder such as when transporting boxes or other items into and out of the attic when the ladder is deployed.

Yet another approach is to include a hand railing as part of the ladder, where the hand railing deploys and extends above the ladder into the attic when the ladder is deployed. However, this approach requires that a person descending the ladder must step onto the ladder at a location below the attic floor. Also, the railing may interfere with transporting boxes or other items into and out of the attic when the ladder is deployed.

A similar problem arises when it is desirable to provide access for reaching the top of a large vehicle, such as a large van or camper. Often, a small ladder is mounted to the rear of the vehicle for this purpose. Due to requirements when driving, the ladder does not typically extend above the level of the roof of the vehicle, making it difficult and potentially dangerous to climb. In addition, a user is forced to climb the ladder vertically, which is less stable and more dangerous than climbing a ladder at an angle. Also, as the user reaches the top of the vehicle, the roof extends only in one direction, so that the user is forced to dismount from the ladder by stepping forward, and cannot for example step off the ladder to the side.

What is needed therefore is an easier, safer, and more convenient method of gaining access to an attic, to a vehicle roof, or to another elevated surface or upper floor level for which access by conventional straight or folding ladders, stairs or other means is impractical.

SUMMARY OF THE INVENTION

The present invention is a stowable pull-down ladder which telescopes for extended length both downward and upward from its point of attachment at the attic floor or second level, so that it extends from the floor below to above the attic floor sufficiently far to provide an extended climbing structure for safe and convenient ascension from the floor below to a standing position on the attic or elevated floor surface or platform.

In embodiments that apply to vehicles, the pull-down ladder can be mounted to the roof of the vehicle such that it can be stowed horizontally under the roof when not in use and does not consume valuable interior space within the vehicle. When the ladder is deployed, the lower portion extends downward at an angle and the upper portion can be extended upward through a sun roof or other opening in the vehicle roof. A user can then climb to the roof from within the vehicle and can hold onto the upper, extended portion while emerging to the roof level, and can step off of the ladder in any desired direction. This approach is thereby much more convenient and much safer than conventional vehicle roof ladders that are mounted to the exterior of the vehicle and do not extend above the roof level.

The present invention is a collapsible attic ladder that includes a lower portion and an upper portion, the upper portion being extendable and retractable between an extended configuration and a contracted configuration. The ladder further includes a mounting and pivoting mechanism located between the upper portion and the lower portion, the mounting and pivoting mechanism being mountable to a stationary structure so that the lower portion can be pivoted downward about the mounting and pivoting mechanism from a stored configuration to a deployed configuration, and the upper portion can be extended above the mounting and pivoting mechanism when the lower portion is in the deployed configuration.

In embodiments, the upper portion can be extended by telescopic extension. In some embodiments the upper portion can be extended by unfolding folded parts of the upper section.

In other embodiments the lower portion is extended in length in the deployed configuration and contracted in length in the stowed configuration. In some of these embodiments the lower portion is extended and contracted in length by telescopic extension and contraction. And in some of these embodiments a spacing between a lowest rung and a next-lowest rung of the lower portion is greater than a spacing between other rungs of the ladder, thereby maintaining a gap between the lowest and next-lowest rungs when the lower portion is contracted into the stowed configuration, and avoiding a danger of injury to hands of a user grasping the lowest rung during contraction of the lower portion.

On other embodiments where the lower portion is extended in length in the deployed configuration and contracted in length in the stowed configuration, the lower portion is extended in length by unfolding of folded parts of the lower portion. In yet other of these embodiments, the upper portion is automatically extended to the extended configuration when the lower portion is extended in length.

In embodiments, the upper portion can be manually extended to the extended configuration after the lower portion is pivoted to the deployed configuration. In various embodiments the upper portion is automatically extended to the extended configuration when the lower portion is pivoted to the deployed configuration.

In certain embodiments the mounting and pivoting mechanism can be mounted proximal to an opening that provides a passage from a floor of an upper room through a ceiling of a lower room, so that the lower portion when in the deployed configuration extends from a floor of the lower room to the ceiling of the lower room, and the upper portion when in the extended configuration extends above the floor of the upper room. In some of these embodiments the ladder is cooperative with a door that closes the opening in the ceiling of the lower room, so that opening of the door automatically initiates pivoting of the ladder to its deployed configuration, and pivoting of the ladder to its stowed configuration automatically initiates closing of the door. In other of these embodiments the ladder is configured in a horizontal orientation substantially filling the opening when the lower portion is in the stowed configuration and the upper section is in the contracted configuration.

In some embodiments the mounting and pivoting mechanism can be mounted proximal to an opening in a roof of a vehicle, so that the lower portion when in the deployed configuration extends from the vehicle roof into the vehicle, and the upper portion when in the extended configuration extends above the roof of the vehicle.

Other embodiments further include at least one gas spring that assists in retracting the lower portion to its stowed configuration.

Certain embodiments further include a stowage latch configured to retain the lower portion in its stowed configuration until the stowage latch is released. And various embodiments further include a deployment latch configured to retain the lower position in its deployed configuration until the deployment latch is released.

In some embodiments the ladder is able to support a user weighing up to 300 pounds without mechanical malfunction. In other embodiment the upper portion includes exactly three rungs.

In various embodiments a spacing between a lowest rung and a next-lowest rung of the lower portion is greater than a spacing between the other rungs of the ladder when the lower portion is in the stowed configuration, thereby maintaining a gap between the lowest and next-lowest rungs and avoiding danger of injury to hands of a user grasping the lowest rung when stowing the lower portion.

And in certain embodiments the ladder is configured for mounting within a vehicle, so that the ladder is stowed horizontally below the vehicle roof when the lower portion is pivoted upward into the stowed configuration, and the upper portion of the ladder is extendable through an opening in the vehicle roof when the lower portion is pivoted downward into the deployed configuration.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
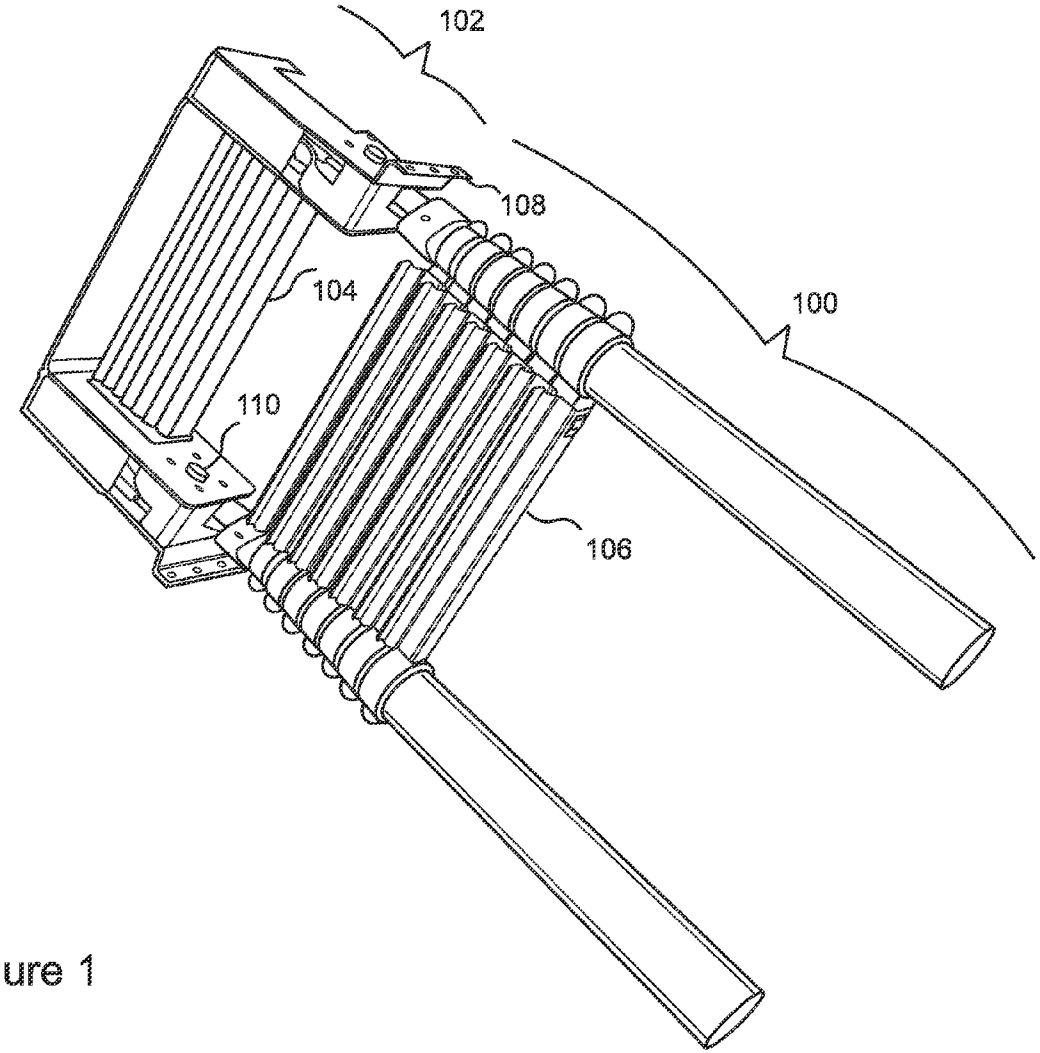
FIG. 1 is a perspective view of an embodiment of the present invention in its fully collapsed configuration.

The invention is susceptible to many variations. Accordingly, the drawings and following description of various embodiments are to be regarded as illustrative in nature, and not as restrictive.

The present invention provides a pull-down attic ladder having an upper portion which telescopes and extends above the opening in the attic floor to provide an extended climbing structure extending to above the attic floor enabling users to continue a secure climbing motion with full hand support sufficiently above attic floor level to gain a standing position in the attic. Note that, except where the context requires otherwise, the term "attic" is used herein generically to describe any space having a floor level or surface with an opening or scuttle through which a ladder can penetrate, and an accessible lower level area or floor below the attic floor into which the ladder can be extended and from which a person can ascend the ladder into the attic. Similarly, the area below the attic is referred to generically herein as the "top floor," and the floor of the attic is sometimes referred to as the "ceiling" of the top floor.

In embodiments, the pull-down ladder of the present invention is able to be installed in the ceiling between the top floor and the attic. In some of these embodiments it can be stowed in a telescopically collapsed or partly collapsed state in a horizontal or non-horizontal orientation. In various of these embodiments, the pull-down ladder is hinged at a selected rung, such as the fourth rung from the top, with a latching pivot that is secured to or proximate the attic floor. In some of these embodiments, the ladder extends automatically upward from the pivot point to above the attic floor when the lower portion of the pull-down ladder is extended, thereby providing a secure hand hold as a person ascends the ladder. In other of these embodiments, the upper portion of the pull-down ladder can be extended manually as the person climbs the ladder.

In various embodiments, the lower portion of the ladder includes a suitable fixed length. In other embodiments, the lower portion can be folded, while in still other embodiments the lower portion can be telescopically extended, downward to the floor or surface from which a person will begin his or her ascent to the attic.

The present invention provides an improved and unique attic ladder, as compared to prior art ladders that do not extend above the attic floor. The extension of the upper portion of the ladder above the attic floor provides added stability and safety to a person getting off of the ladder and stepping or crawling onto the attic floor. Likewise, the ladder provides added security and safety by enabling a person to grasp the upper portion extended above the attic floor while crawling or stepping from the attic floor onto rungs of the ladder, rather than groping for a top rung with feet hanging below the floor surface and with no handhold available for grasping.

As mentioned above, in some embodiments the telescoping upwards of the upper portion of the ladder from the pivot point is independent of the extension downwards of the lower portion of the ladder. This may be advantageous in the case of a person carrying a package up the ladder, since it enables them to leave the upper portion of the ladder in the collapsed state so as not to get in the way of the package. After depositing the package on the attic floor, the upper portion of the ladder can then be telescoped upwards to facilitate the remainder of the ascent.

FIG. 1 illustrates an embodiment for which both the lower portion 100 and the upper portion 102 are telescopically extendable. The embodiment is shown in its fully collapsed or retracted state, with the upper steps 104 and the lower steps 106 compressed against each other, and the mounting bracket 108 detached from the attic floor and pivoted about its pivot axis 110 into a storage position.

Figure 2:
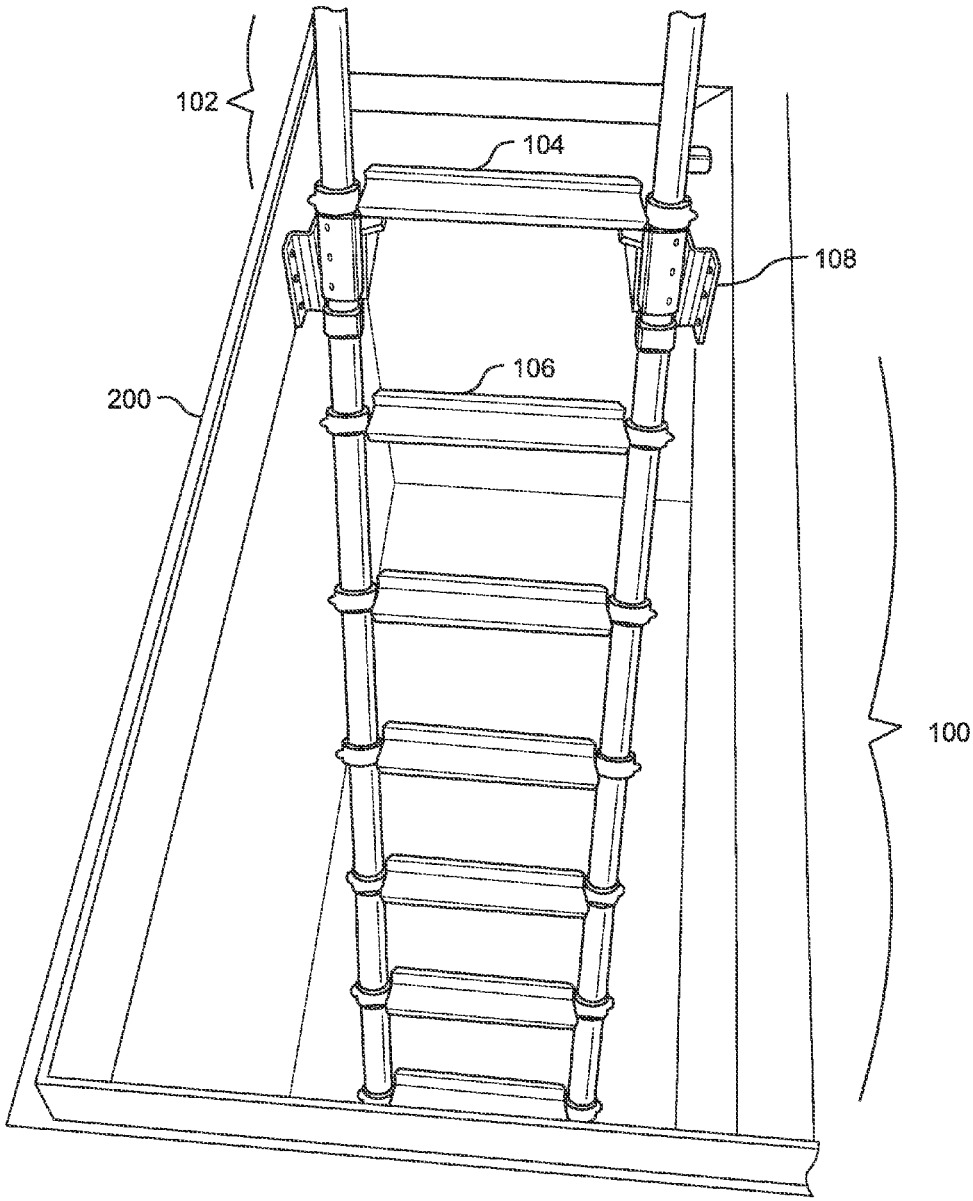
FIG. 2 is a perspective front view of a lower portion of the embodiment of FIG. 1 in its extended configuration rising as seen through an opening in the floor of an attic.
Figure 3:
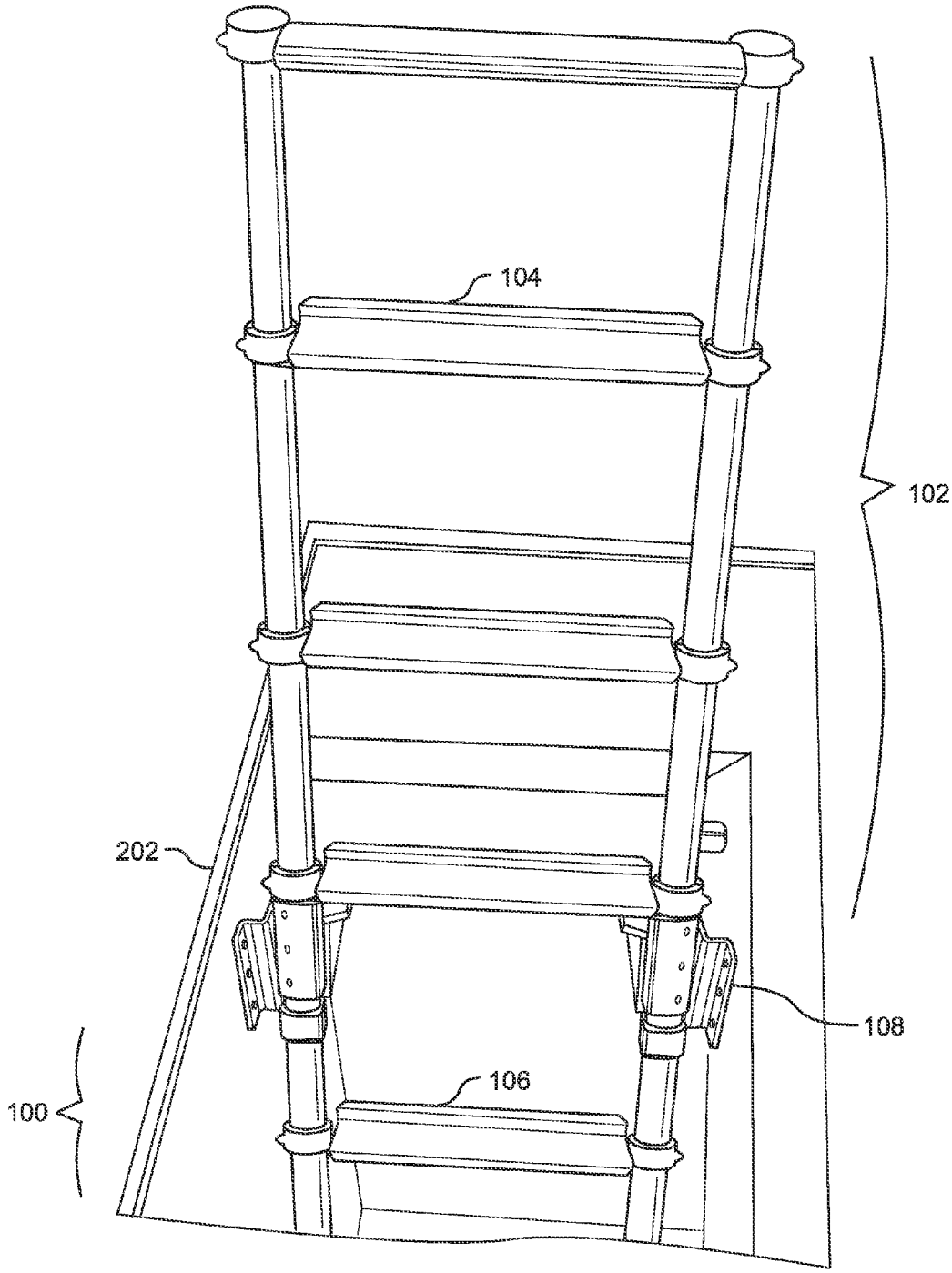
FIG. 3 is a perspective front view of an upper portion of the embodiment of FIG. 1 in its extended configuration rising above the opening in the floor of the attic.
Figure 4:
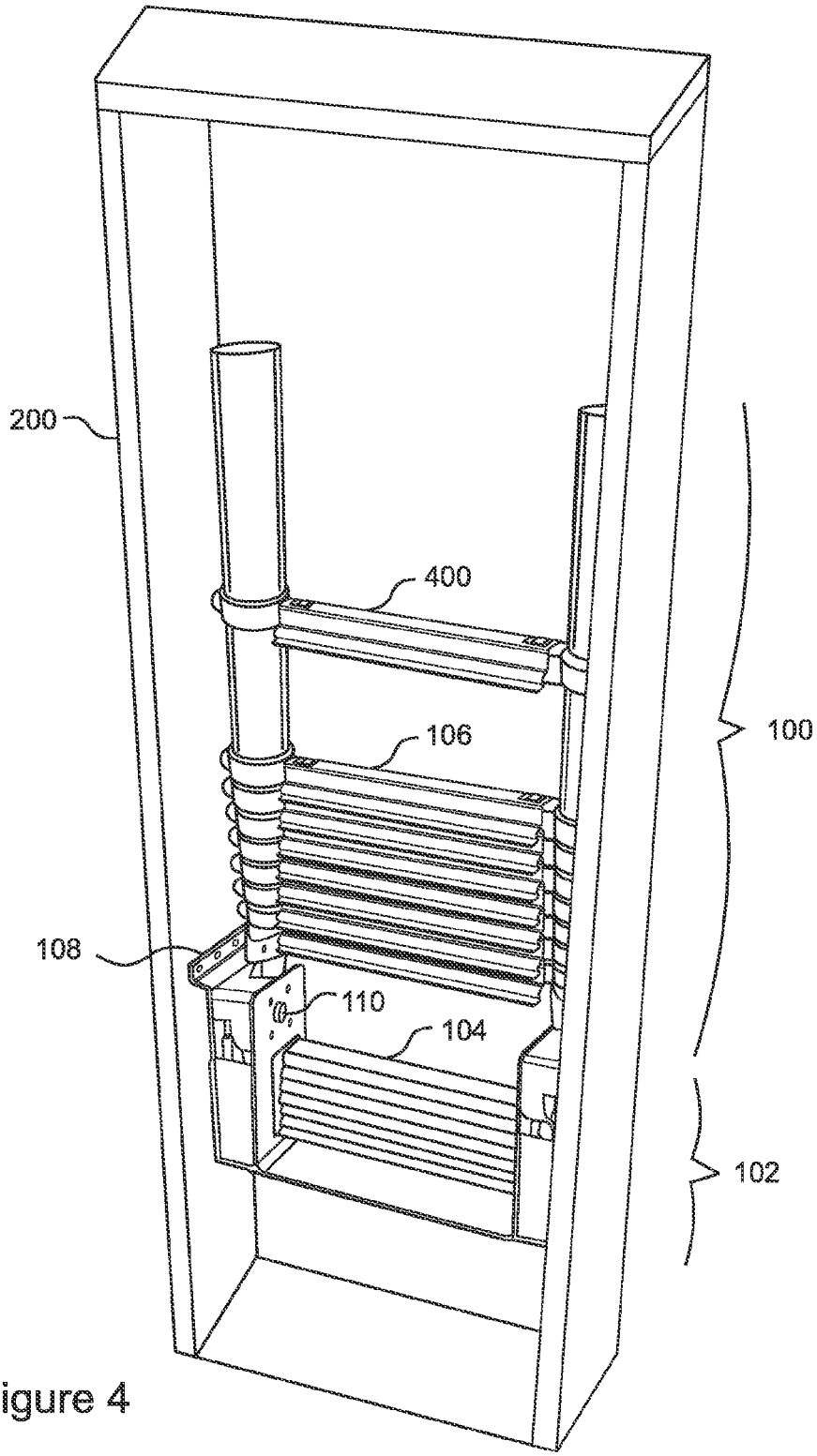
FIG. 4 is a perspective view from below of the embodiment of FIG. 1 in a partially collapsed configuration stowed within the floor of the attic.

FIG. 2 illustrates the embodiment of FIG. 1 extending from the top floor up through an opening 200 in an attic floor. The ladder in FIG. 2 is secured to the attic floor opening 200 by attachment of the mounting bracket 108 to the floor opening 200. FIG. 3A is a front view of the upper portion 102 of the ladder of FIG. 2, showing the top three rungs 104 of the ladder telescoped above the opening 200 in the attic floor. FIG. 4 shows the ladder of FIGS. 1-3 in a partially collapsed configuration pivoted into an out-of-the-way angle while not in use. In the embodiment of FIG. 4 the lowest step 4 is separated from the other steps 106 of the lower portion 100, so that when collapsing the ladder a user's fingers will not be crushed if the user grasps the lower portion 100 by grasping the lowest step 400.

Figure 5:
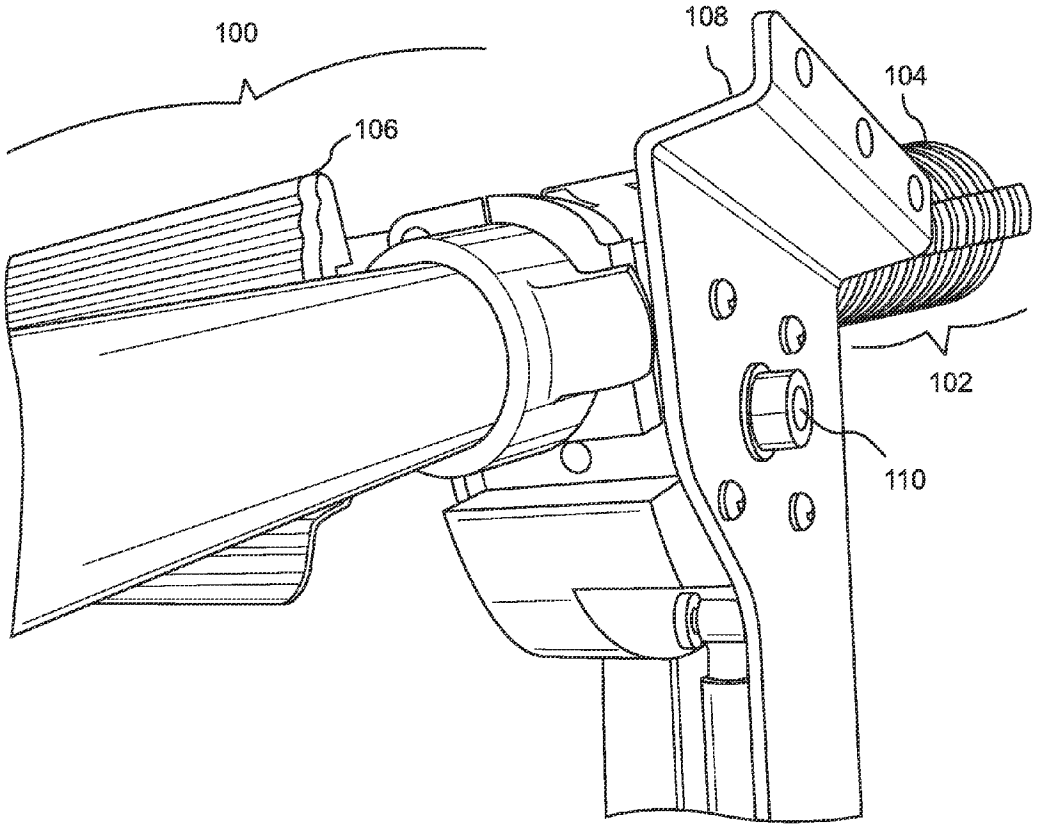
FIG. 5 is a close-up perspective view of a pivot joint of the embodiment of FIG. 1.

FIG. 5 is a close-up illustration of one of the pivot hinge points 104 of the embodiment of FIGS. 1-4. Although only a portion of the hinge point 104 is included in the figure, it can be seen that the hinge point 104 has been rotated about its pivot axis 106 into its deployed position.

Figure 6:
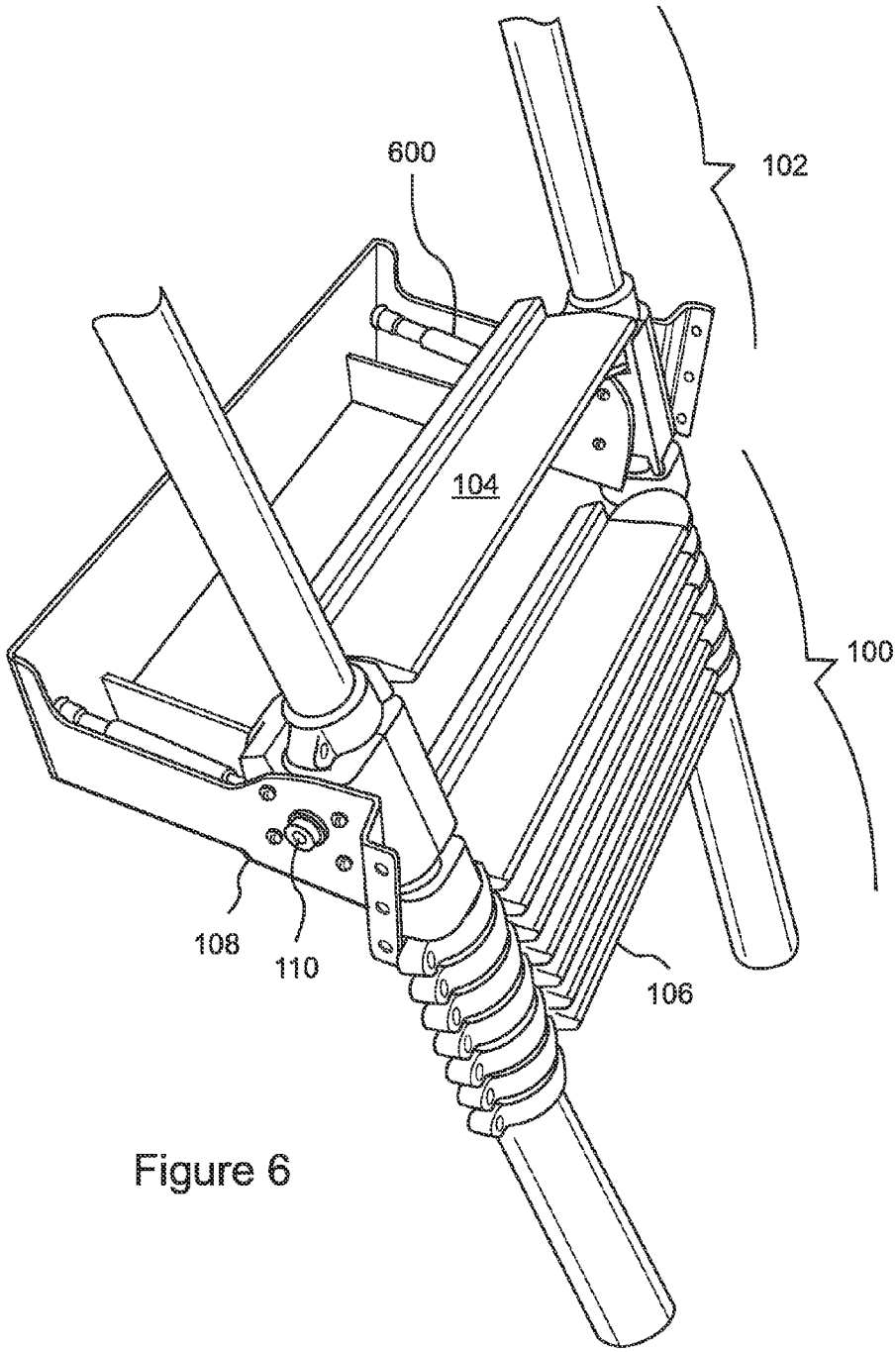
FIG. 6 illustrates the lower portion of the embodiment of FIG. 1 with the bottom rungs of the ladder in a retracted or collapsed state.

FIG. 6 illustrates the lower portion of the embodiment of FIGS. 1-5 with the bottom rungs of the ladder in a retracted or collapsed state. A pair of gas springs 600 is visible which assists in retracting the lower portion 100 to its stowed configuration.

Figure 7:
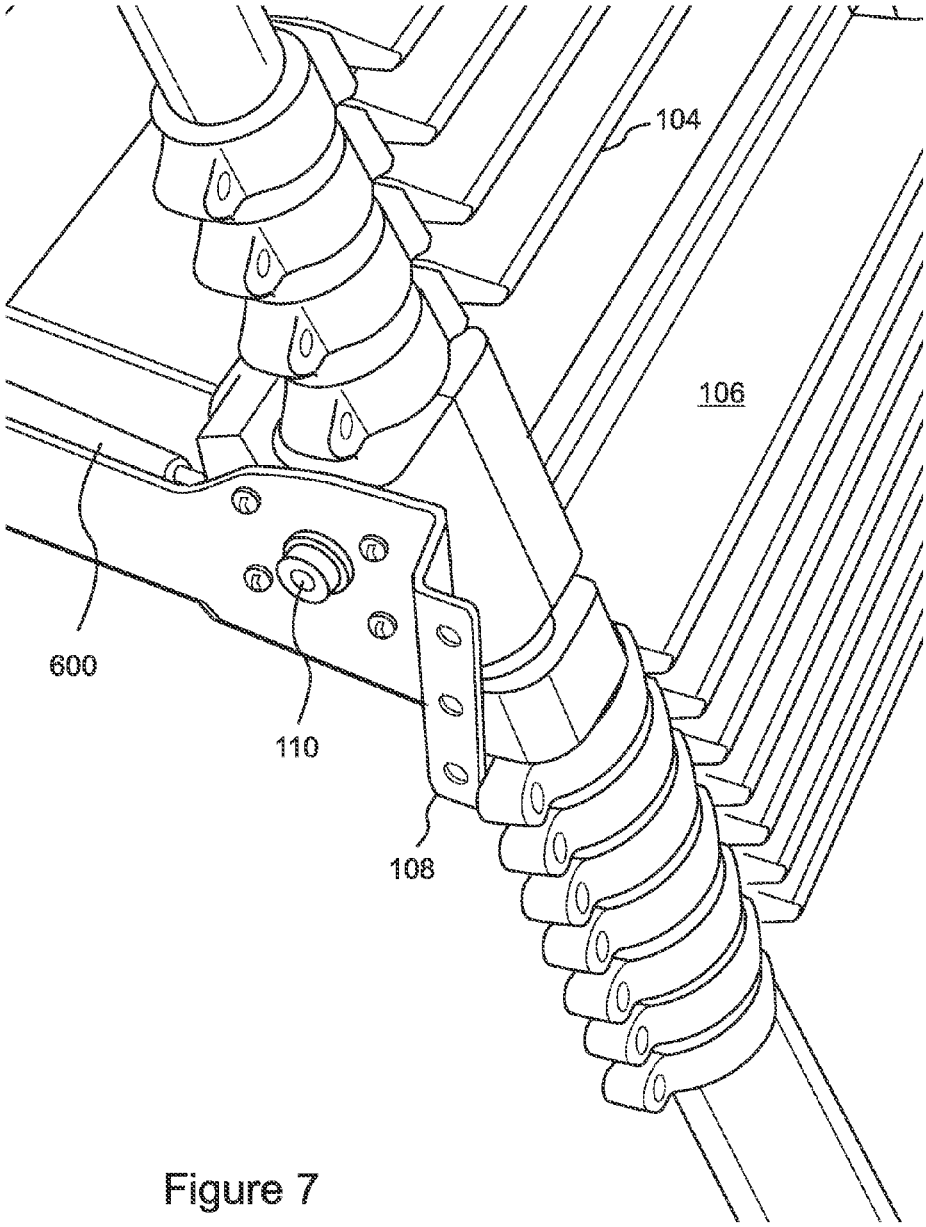
FIG. 7 is a close-up view of one of the pivot hinge points of the embodiment of FIG. 1 showing the ladder in its fully collapsed configuration with all of the top and bottom rungs in a retracted or collapsed state.

FIG. 7 is a close-up view of one of the pivot hinge points showing the ladder in its fully collapsed configuration with all of the top and bottom rungs in a retracted or collapsed state.

In embodiments, the ladder can be retracted to its horizontal stored position with two gas springs 600 and retained there by a latch incorporated in the pivot. In some of these embodiments, if the stowed ladder is pushed toward the pivot, the latch is released and the ladder can be pulled down, extended and pivoted to an extended configuration where it latches automatically. In some embodiments, pivoting and extending the lower portion downward automatically extends the upper portion above the attic floor. In other embodiments the upper portion, which in some embodiments includes the upper three rungs, can be extended manually as a person climbs the ladder.

In various embodiments, the pivot latches are strong enough to enable a person weighing as much as 300 pounds to climb the ladder above the attic floor. In embodiments, after a person descends the ladder, he or she can simply lift the ladder from the base toward the pivot. In some of these embodiments, when the sections below the pivot are pushed up to the pivot, they release the pivot latch and at the same time collapse the section above the pivot, so that the ladder can be effortlessly (with the gas spring assist) pushed back into the ceiling. In embodiments, the automatic latch release, the automatic top rung collapse and the pivoting of the ladder to its storage orientation is one continuous smooth motion. In some embodiments the pivot/auto-latch/auto-top rung release is fabricated from aluminum. In other embodiments, it is molded from the same plastic that is used for the rung ends.

Similar embodiments do not include a storage latch, and are held in the storage orientation by gas springs. In some embodiments, an extension latch is included in the pivot that prevents the ladder from prematurely extending as it is pivoted downward. Various embodiments include an adjustable mounting system. As an additional safety precaution, some embodiments include an additional spacing between the bottom two rungs of the ladder, where a person's hands are likely to be when the ladder is telescoping or collapsing.

In embodiments, as each rung on the ladder is telescoped out a latch on that rung is automatically engaged to hold the rung in the extended position and provide increased overall stability for the ladder. In some of these embodiments, As the ladder is collapsed back into itself, each rung engages a latch release mechanism on the next rung that is about to be collapsed, allowing the collapsing process to continue in a cascading sequence.

In some embodiments, a door under the ladder is linked to the ladder such that the ladder provides the return for the door.

Embodiments of the present invention offer greater convenience and safety compared to existing pull-down attic ladders. Other applications for the present invention include deployment through a hole in the roof of a van or motorhome to gain access to the roof of the vehicle.

In embodiments that apply to vehicles, the pull-down ladder can be mounted to the roof 800 of the vehicle such that it can be stowed horizontally under the roof 800 when not in use proximal to a sun-roof or other opening 802 in the roof. In this way the ladder does not consume valuable interior space within the vehicle when it is stowed. When the ladder is deployed, it extends at an angle, and a user can climb it from within the vehicle, can continue to hold onto the upper, extended portion while emerging to the roof level, and can step off of the ladder in any desired direction. This approach is thereby much more convenient and much safer than conventional vehicle roof ladders that are mounted to the exterior of the vehicle and do not extend above the roof level.

Figure 8:
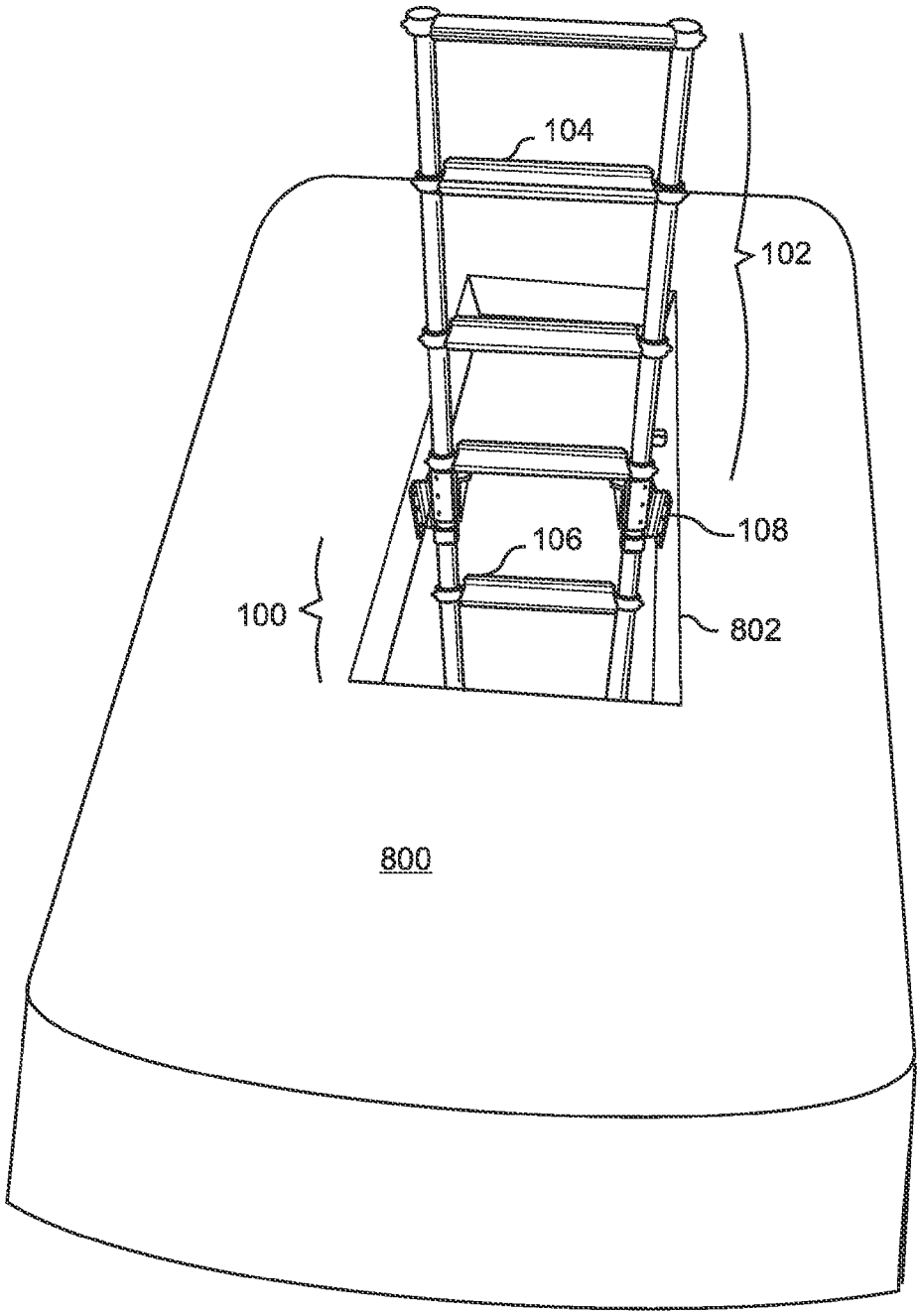
FIG. 8 is a perspective front view of an upper portion of an embodiment similar to FIG. 1 in its extended configuration rising above the roof of a vehicle.

With reference to FIG. 8, in embodiments that apply to vehicles, the pull-down ladder can be mounted to the roof 800 of the vehicle such that it can be stowed horizontally under the roof 800 when not in use and does not consume valuable interior space within the vehicle. When the ladder is deployed, the lower portion 100 extends downward at an angle and the upper portion 102 can be extended upward through a sun roof 802 or other opening in the vehicle roof 800. A user can then climb to the roof from within the vehicle and can hold onto the upper, extended portion 102 while emerging to the roof level, and can step off of the ladder in any desired direction. This approach is thereby much more convenient and much safer than conventional vehicle roof ladders that are mounted to the exterior of the vehicle and do not extend above the roof level.

As will be realized, the present invention is capable of other and different embodiments, and its several details are capable of modifications in various obvious respects, all without departing from the essence of the invention. For instance, the invention may be practiced as an apparatus and/or process, and can be scaled. There is within the scope of the invention, an attic ladder comprising a plurality of rungs capable of telescoping from a retracted configuration to an extended configuration and a mounting point located between two of the plurality of rungs, whereby the ladder can be mounted to or near the floor level of an attic such that a first subset of the plurality of rungs extends above the attic floor and a second subset of the plurality of rungs extends down from the attic floor towards a lower floor.

The invention may be in the form of a ladder system secured at floor level that includes an upper portion that is extendible and retractable above the floor and a lower portion that is extendible and retractable to a lower level floor. The upper portion can extend automatically above the floor upon extension of the lower portion, or may be activated or operated independently of the lower section. Ladder extension can be telescopic or by unfolding of sections. Retraction of either or both ladder portions may include a pivoting capability to reduce vertical height when stored. A gap can be provided between lowest rungs of a lower telescoping portion to avoid danger to a user's hands. Embodiments can be used to access the top of a vehicle roof from within the vehicle, or to provide climbing and descending access between floor levels of any structure, vessel or vehicle.

The term "telescoping" as used herein is not limited to purely lineal extension of tubular legs, but also embraces any mechanism that upon extension, places the ladder rungs or steps at a suitably uniform distance apart from each other for climbing, and upon retraction brings the rungs closer together. Some embodiments are be of a hybrid nature, employing a mechanism other than linear telescoping ladder legs for extending in one or both of the upward and downward directions from the pivot point. Some embodiments hold the ladder at a fixed angle and only employ lengthwise extension mechanisms. Other embodiments enable rotation of the collapsed ladder to a horizontal orientation or to another convenient angle for stowage and to minimize its vertical dimension or interference with otherwise usable space while stowed.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A collapsible attic ladder system comprising:

a horizontal structural element; and an opening that penetrates the horizontal structural element; and a ladder having a stowed configuration and a deployed configuration; and a lower portion of the ladder having rungs and an upper portion of the ladder having rungs, the upper portion being extendable to an extended configuration and collapsible to a contracted configuration, the upper and lower portions being constrained to be in alignment with each other when the ladder is in its deployed configuration; and a mounting and pivoting mechanism located between the upper portion and the lower portion, the mounting and pivoting mechanism being mounted in the opening in the horizontal structural element so that the ladder can be pivoted about the mounting and pivoting mechanism between the stowed configuration and the deployed configuration, and so that the rungs of the upper portion can be extended above the mounting and pivoting mechanism through the opening and above the horizontal structural element when the ladder is in the deployed configuration;

wherein the lower portion is extended in length when the ladder is in the deployed configuration and contracted in length when the ladder is in the stowed configuration, wherein the lower portion can be extended in length to a lower extended configuration by telescopic extension and contracted in length to a lower contracted configuration by telescopic contraction;

wherein a spacing between a lowest rung and next-lowest rung of said rungs of the lower portion is greater in distance than a spacing between other rungs of said rungs of the lower portion of the ladder, thereby maintaining a gap between the lowest and next-lowest rungs when the lower portion is in the lower contracted configuration to avoid a danger of injury to hands of a user grasping the lowest rung during contraction of the lower portion;

wherein the horizontal structural element is a ceiling of a lower room that provides a passage through the opening from a floor of an upper room through the ceiling of the lower room, so that the lower portion of the ladder when in the deployed configuration extends from a floor of the lower room to the ceiling of the lower room, and the upper portion when in the extended configuration extends above the floor of the upper room, wherein the ladder is configured to be able to be in a horizontal orientation substantially filling the opening when the ladder is in the stowed configuration and the upper portion is in the contracted configuration.

2. The ladder of claim 1, wherein the upper portion can be extended by telescopic extension.

3. The ladder of claim 1, wherein the upper portion can be manually extended to the extended configuration after the lower portion is pivoted to the deployed configuration.

4. The ladder of claim 1, further comprising at least one gas spring that assists in retracting the lower portion when the ladder is moved to its stowed configuration.

5. The ladder of claim 1, wherein the ladder is able to support a user weighing up to 300 pounds without mechanical malfunction.

6. A collapsible vehicle ladder system comprising:

a horizontal structural element; and an opening that penetrates the horizontal structural element; and a ladder having a stowed configuration and a deployed configuration; and a lower portion of the ladder having rungs and an upper portion of the ladder having rungs, the upper portion being extendable to an extended configuration and collapsible to a contracted configuration, the upper and lower portions being constrained to be in alignment with each other when the ladder is in its deployed configuration; and a mounting and pivoting mechanism located between the upper portion and the lower portion, the mounting and pivoting mechanism being mounted in the opening in the horizontal structural element so that the ladder can be pivoted about the mounting and pivoting mechanism between the stowed configuration and the deployed configuration, and so that the rungs of the upper portion can be extended above the mounting and pivoting mechanism through the opening and above the horizontal structural element when the ladder is in the deployed configuration;

wherein the lower portion is extended in length when the ladder is in the deployed configuration and contracted in length when the ladder is in the stowed configuration, wherein the lower portion can be extended in length to a lower extended configuration by telescopic extension and contracted in length to a lower contracted configuration by telescopic contraction;

wherein a spacing between a lowest rung and next-lowest rung of said rungs of the lower portion is greater in distance than a spacing between other rungs of said rungs of the lower portion of the ladder, thereby maintaining a gap between the lowest and next-lowest rungs when the lower portion is in the lower contracted configuration to avoid a danger of injury to hands of a user grasping the lowest rung during contraction of the lower portion;

wherein the horizontal structural element is a roof of a vehicle, so that the lower portion when the ladder is in the deployed configuration extends from the roof into the vehicle below the roof, and at least one rung of the rungs of the upper portion extends above the roof of the vehicle when in the extended configuration, wherein the ladder is stowed horizontally below the roof when the ladder is pivoted into the stowed configuration, and the upper portion of the ladder is extendable through the opening when the ladder is pivoted into the deployed configuration.

7. The ladder of claim 6, wherein the upper portion can be extended by telescopic extension.

8. The ladder of claim 6, wherein the upper portion can be manually extended to the extended configuration after the lower portion is pivoted to the deployed configuration.

9. The ladder of claim 6, further comprising at least one gas spring that assists in retracting the lower portion when the ladder is moved to its stowed configuration.

10. The ladder of claim 6, wherein the ladder is able to support a user weight up to 300 pounds without mechanical malfunction.

* * * * *